US005620382A

United States Patent [19]

Cho et al.

[11] Patent Number: 5,620,382

[45] Date of Patent: Apr. 15, 1997

[54] DIAMOND GOLF CLUB HEAD

[75] Inventors: Hyun S. Cho, 1804 Fort Douglas Cir., Salt Lake City, Utah 84103; Bong K. Lee; Yong I. Kim, both of Sungnam, Rep. of Korea; Nam K. Jin, Seoul, Rep. of Korea; Kyoung R. Han, Cheonan, Rep. of Korea

[73] Assignee: Hyun Sam Cho, Salt Lake City

[21] Appl. No.: 617,343

[22] Filed: Mar. 18, 1996

[51] Int. Cl.[6] ..... A63B 53/04

[52] U.S. Cl. ..... 473/331; 473/342; 473/340

[58] Field of Search ..... 473/324, 329, 473/330, 331, 335, 340, 342, 347, 349, 350, 345, 282, 291, 288, 251, 240

[56] References Cited

U.S. PATENT DOCUMENTS

| | | | |
|---|---|---|---|
| 3,141,746 | 7/1964 | De Lai . | |
| 3,233,988 | 2/1966 | Wentorf, Jr. et al. . | |
| 3,745,623 | 7/1973 | Wentorf, Jr. et al. . | |
| 3,975,023 | 8/1976 | Inamori | 473/342 |
| 4,224,380 | 9/1980 | Bovenkerk et al. . | |
| 4,569,524 | 2/1986 | Quijano | 473/342 |
| 4,768,787 | 9/1988 | Shira | 473/331 |
| 4,917,384 | 4/1990 | Caiati | 473/330 |
| 4,951,953 | 8/1990 | Kim . | |
| 5,029,865 | 7/1991 | Kim . | |
| 5,096,465 | 3/1992 | Chen . | |
| 5,342,812 | 8/1994 | Niskanen et al. . | |
| 5,362,055 | 11/1994 | Rennie . | |
| 5,486,137 | 1/1996 | Flood . | |

*Primary Examiner*—Sebastiano Passaniti
*Attorney, Agent, or Firm*—Thorpe, North & Western, LLP

[57] ABSTRACT

A golf club head comprising a ball striking face with an insert of polycrystalline diamond (PCD), polycrystalline cubic boron nitride (PCBN), cemented compact, or single diamond crystal is described. Such inserts, because of their hardness and strength, provide for greater distance and accuracy of golf shots as compared to softer materials. These inserts have a mirror-like finish that is resistant to scratches, chips, and deformation.

34 Claims, 2 Drawing Sheets

DIAMOND GOLF CLUB HEAD

BACKGROUND OF THE INVENTION

This invention relates to a golf club head. More particularly, the invention relates to a golf club head with an insert integrally bonded to the club face wherein the insert comprises an extremely hard and durable surface for contacting the ball and efficiently transferring energy thereto.

Designers of golf equipment have long sought after an optimum design of golf clubs and balls, both in terms of physical design and selection of materials, for achieving maximum performance. There have been numerous efforts to arrive at innovative designs of club heads, club head materials, and shaft materials for maximum performance, i.e. distance that the ball is propelled after being struck.

Traditionally, woods (clubs usually used for tee shots and longer fairway shots) have heads made of hard wood, the preferred wood being persimmon. The tendency of wood to warp or split, however, coupled with increasing costs of material and labor, has led to development of woods fabricated of materials other than wood. For example, there are many different kinds of engineered materials currently being used in the construction of the club head or club face, such as steels, cast irons, aluminum, copper, titanium, graphite, plastics, woods, and carbides and their alloys and composites. For example, there is a club referred to as an "insert in metal head," wherein the head of the club is made of metal with a full face graphite insert, commercially available as "THUNDER HEAD WOOD" from Spalding, or an engineered plastic insert, commercially available as "ODYSSEY." G. Rennie, U.S. Pat. No. 5,362,055, describes a "metal wood" wherein the club head is molded or formed in substantially one piece, but a nonmetallic insert is secured to a cavity formed in the ball striking face. P. Niskanen et al., U.S. Pat. No. 5,342,812, disclose golf club heads that utilize composite materials, such as metal matrix composite and/or ceramic matrix composite materials, for the body, face, and/or sole of the club head.

D. Kim, U.S. Pat. Nos. 4,951,953 and 5,029,865, states the desirability of using rigid materials, i.e. materials with a high "Young's Modulus," in golf clubs such that the distance travelled by the ball is increased. Kim discloses golf clubs wherein the head, shaft, or both are coated with such materials. A particularly preferred material is a diamond-containing coating, because diamond is the hardest material known and has the highest Young's Modulus. Kim recognizes that a coating of pure diamond would be ideal, but states that such coatings are difficult and costly to apply, and the pure diamond material is itself costly. Therefore, Kim teaches coatings of 10–100 μm electroless composite material wherein diamond particles are embedded in a metal or metal alloy matrix, such as a nickel matrix, such that the diamond particles are weakly cemented together by the soft metal without any diamond-diamond bonds.

In view of the foregoing, it will be appreciated that providing a golf club head comprising an insert in the ball striking face, wherein the insert comprises a compact such that particles of material having a high Young's Modulus are bonded to each other, would be a significant advancement in the art.

OBJECTS AND SUMMARY OF THE INVENTION

It is an object of the present invention to provide a golf club head comprising an insert in the ball striking face having a high Young's Modulus.

It is also an object of the invention to provide a golf club head insert comprising a polycrystalline diamond (PCD) or polycrystalline cubic boron nitride (PCBN) compact wherein the individual crystals are bonded together, respectively, by diamond-diamond or CBN-CBN bonds.

It is another object of the invention to provide a golf club head insert with a mirror-like finish that is resistant to scratches, chips, and deformation.

It is still another objection of the invention to provide a golf club head insert that transfers a maximum amount of energy to a golf ball being struck therewith.

These and other objects are provided by a golf club head comprising:

a ball striking face having a receiving cavity formed therein for receiving a golf club head insert; and a golf club head insert comprising (a) a surface layer of a compact material comprising a member selected from the group consisting of diamond and CBN crystals wherein the crystals are bonded together by diamond-diamond or CBN-CBN bonds between adjacent crystals, and (b) a support layer of a hard, rigid material to which the surface layer is bonded, wherein the golf club head insert is disposed in the receiving cavity such that the surface layer is coplanar with the ball striking face. The compact material is preferably a member selected from the group consisting of PCD, thermally stable PCD, reinfiltrated PCD, and CVD diamond film, and the surface layer preferably has a thickness of about 0.1 to about 20 mm. The face can be adapted for use in a putter or for use in a wood or iron. When used in a wood or iron, the insert preferably has a grooved surface layer.

In another embodiment, a golf club head comprises:

a ball striking face having a receiving cavity formed therein for receiving a golf club head insert; and a golf club head insert comprising a layer of a compact material comprising a member selected from the group consisting of diamond and CBN crystals wherein the crystals are bonded together by diamond-diamond or CBN-CBN bonds between adjacent crystals, wherein the golf club head insert is disposed in the receiving cavity such that the surface layer is coplanar with the ball striking face.

In yet another embodiment, a golf club head comprises:

a ball striking face having a receiving cavity formed therein for receiving a golf club head insert; and a golf club head insert comprising (a) a surface layer of a material comprising a member selected from the group consisting of a cemented compact and a single crystal diamond, and (b) a support layer of a hard, rigid material to which the surface layer is bonded, wherein the golf club head insert is disposed in the receiving cavity such that the surface layer is coplanar with the ball striking face. In a surface layer comprising a cemented compact, such cemented compact preferably comprises about 5–93% by volume of diamond or CBN and about 7–95% by volume of a binder material. More preferably, such cemented compact comprises about 50–92% by volume of diamond or CBN and about 8–50% by volume of a binder material. It is also preferred that the surface layer have a thickness of about 0.1 to about 20 mm.

DETAILED DESCRIPTION OF THE INVENTION

Figure 1A:
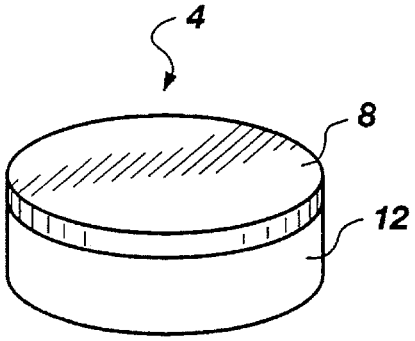
FIG. 1A shows a perspective view of an illustrative embodiment of a golf club head insert according to the instant invention.

Before the present golf club head is disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

In describing and claiming the present invention, the following terminology will be used in accordance with the definitions set out below.

As used herein, "compact" means a mass of diamond or cubic boron nitride (CBN) crystals, in whole or in portions, that are bonded, joined, or united together, respectively, by diamond-diamond bonds or CBN-CBN bonds obtained between many adjacent crystals.

As used herein, "PCD" or "polycrystalline diamond" means a diamond material containing a high degree of diamond-diamond bonds manufactured by a high pressure, high temperature (HPHT) process such as described in Wentorf, Jr. et al., U.S. Pat. No. 3,745,623, hereby incorporated by reference. PCD ordinarily contains in the range of about 50–99% by volume of diamond and about 1–50% by volume of a sintering aid material used in the process of fabricating PCD to catalyze the formation of diamond-diamond bonds. In general, the greater the amount of diamond material in the PCD compact and the lesser the amount of sintering aid material, the greater the number of diamond-diamond bonds and thus the greater the strength of the PCD compact. Suitable sintering aid materials include iron, cobalt, nickel, ruthenium, rhodium, palladium, osmium, iridium, platinum, titanium, chromium, manganese, and tantalum, as described in De Lai, U.S. Pat. No. 3,141,746, hereby incorporated by reference.

As used herein, "thermally stable PCD" means a temperature-resistant PCD compact made by treating a PCD compact with acid to substantially remove all sintering aid material contained therein, thereby producing a compact consisting essentially of diamond crystals bonded together by diamond-diamond bonds. H. Bovenkerk et al., U.S. Pat. No. 4,224,380, hereby incorporated by reference, describes thermally stable PCD and a method of making thereof. Thermally stable PCD is highly thermally stable because the softer metal is removed from the compact, leaving a diamond skeleton essentially free of materials that tend to weaken the compact upon heating.

As used herein, "reinfiltrated PCD" means a thermally stable PCD compact that is reinfiltrated with a metal or silicon into the intercrystal spaces of the diamond skeleton.

As used herein, "CVD" means a processed diamond or diamond-like material fabricated by chemical vapor deposition according to processes well known in the art. The CVD process can be used to place a diamond or diamond-like thin film onto a selected substrate, such as tungsten carbide, metals, SiC, $Si_3N_4$, molybdenum, and the like. "Diamond-like" refers to a material having a structure between graphite and diamond that is sometimes formed in the diamond-making process.

As used herein, "PCBN" or "polycrystalline cubic boron nitride" compact means a compact formed of crystals of the cubic form of boron nitride. Such a PCBN compact is formed by subjecting crystals of a hexagonal form of boron nitride to HPHT of at least about 1200° C. and 50,000 atmospheres in combination with a catalyst material, such as described in R. Wentorf, Jr., & A. De Lai, U.S. Pat. No. 3,233,988, hereby incorporated by reference. PCBN is a very strong, durable material having a Young's Modulus that is surpassed only by diamond.

As used herein, "cemented compact" means a cemented diamond and/or CBN compact wherein diamond-diamond or CBN-CBN bonding is not required. In such cemented compacts, the diamond and/or CBN content can be in the range of about 5–93% by volume with the remaining 7–95% of the cemented compact comprising a binder. Preferably, the cemented compact comprises about 50–92% by volume of diamond and/or CBN and about 8–50% by volume of binder. In certain embodiments, utility grade diamond, i.e. diamond that has not undergone special steps of cleaning and processing can be used in cemented compacts. Suitable binder matrices include the same materials that are suitable as sintering aid materials in forming PCD compacts as described above. Cemented compacts can be formed by the HPHT process or can be formed at lower temperatures and pressures so long as care is taken to protect the diamond from conversion to graphite. That is, the ranges of temperatures and pressures should be selected such that the diamond is not converted to graphite, as is well known in the art. Cemented compacts exhibit bulk properties of hardness and strength much superior than the metal plating process described by Kim, U.S. Pat. Nos. 4,951,953 and 5,029,865.

As used herein, "single crystal diamond" means a tough, coherent, high strength diamond comprising a single crystal grown synthetically by the HPHT process. Single crystal diamond is commercially available from Sumitomo and DeBeers.

FIG. 1A shows a golf club insert according to the present invention. The insert 4 comprises an upper layer 8 comprising a diamond or PCBN material and a lower layer 12 comprising a support material. The diamond material of the upper layer can be PCD, thermally stable PCD, reinfiltrated PCD, CVD, or synthetic single crystal diamond. The upper layer is very light, much lighter than steel or titanium, for example, but is very strong. The high hardness and coherent impact strength of the diamond or PCNB material renders the upper layer very resistant to scratches, chips, and deformation under normal usage. The upper layer does not absorb as much shock as do conventional materials, such as metals, wood, plastics, and composites, therefore more of the energy of the club head is transferred to the ball. The lower layer 12 of support material should have properties of high strength and hardness, such as can be provided by any conventionally known steels, metals, carbides, ceramics, cermets, and the like. Illustrative support materials of the lower layer include tungsten carbide, copper, tin, brass, nickel, aluminum, silicon, molybdenum, tungsten, cobalt, titanium, zirconium, $Al_2O_3$, SiC, and $Si_3N_4$. The upper layer 8 is bonded to the lower layer 12 by any method known in the art. For example, U.S. Pat. No. 3,745,623 describes methods of forming a PCD compact bonded to a support layer of carbide material. The upper and lower layers can also be bonded by conventional hot pressing, infiltration, chemical joining, and similar processes well known in the art.

Figure 1B:
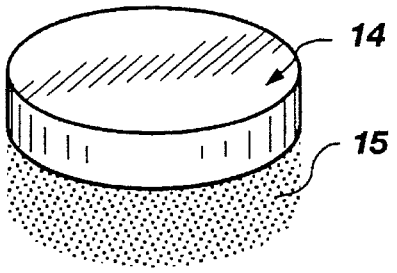
FIG. 1B shows a perspective view of a free-standing PCD or PCBN golf club head insert according to the present invention.

FIG. 1B shows a free-standing PCD or PCBN layer 14 that can also be used as a golf club insert. A support layer 15 is shown in phantom. Such a free-standing PCD or PCBN layer is made by the same methods that are used for making the upper layer 8 of FIG. 1A.

The method of U.S. Pat. No. 3,745,623 for making PCD and bonding PCD to a support layer of carbide material will now be described briefly. Various apparatuses can be used for providing the required temperatures and pressures for carrying out the HPHT process. One such apparatus is that of Hall, U.S. Pat. No. 2,941,248, which is hereby incorporated by reference. The process employed in the practice thereof is described in Wentorf, Jr., U.S. Pat. No. 3,609,818, which is also hereby incorporated by reference. The Hall apparatus includes a pair of cemented tungsten carbide punches and an intermediate belt or die member of the same material. The die member includes an aperture in which there is positioned a reaction vessel. Between the punches and die there are gasket/insulating assemblies. Inside the reaction vessel is a space into which the diamond and sintering aid materials are placed for being treated by the HPHT process. A mass of diamond powder is placed in the reaction vessel and a larger mass of carbide molding powder, such as a mixture of tungsten carbide powder plus cobalt powder, is placed adjacent to the diamond powder. The cobalt functions both as the metal bond for sintering the carbide and as a diamond-making catalyst (sintering aid) for conversion of graphite to diamond. Nickel, iron, and mixtures of cobalt, nickel, and iron can perform the same functions. Pressure is applied to the reaction vessel and then the system is heated. Temperatures of 1300° C.–1600° C. and pressures on the order of 55 kilobars for longer than 3 minutes are sufficient to simultaneously (a) convert the carbide to the sintered state, (b) consolidate the diamond crystals into a mass of sintered diamond (compact), and (c) develop an excellent bond between the diamond compact and cemented carbide mass to produce an integrated mass.

Figure 2:
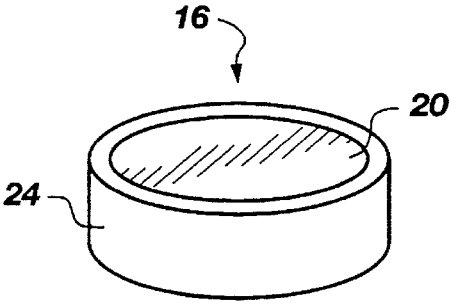
FIG. 2 shows a perspective view of another illustrative embodiment of a golf club head insert according to the present invention.
Figure 3:
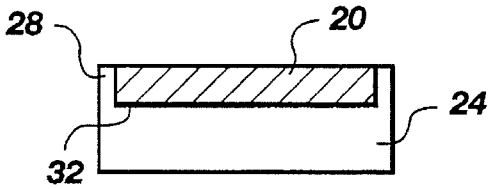
FIG. 3 shows a side, sectional view of the golf club insert of FIG. 2.

FIGS. 2 and 3 show another embodiment of a golf club head insert 16 according to the invention comprising an upper layer 20 and a lower layer 24. The lower layer 24 has an upward extending lip 28 at its periphery for defining a receiving cup 32 for receiving and circumscribing the upper layer 20. Diamond and PCBN materials are very hard, but are also somewhat brittle. Therefore, this embodiment provides a lip of support material for protecting the edge of the upper layer such that fracturing of the edge is inhibited.

Figure 4:
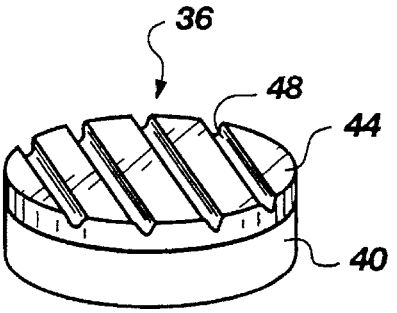
FIG. 4 shows a perspective view of another illustrative embodiment of a golf club head insert according to the present invention wherein the insert comprises grooves for imparting spin to a ball struck therewith.
Figure 5:
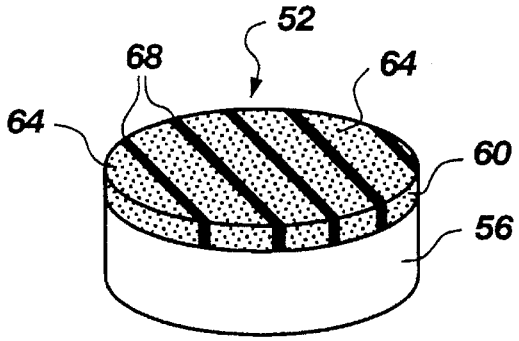
FIG. 5 shows a perspective view of a golf club head insert according to FIG. 4 wherein alternating strips of diamond or PCBN material and a grooving material comprise the upper layer of the insert.

Many golf clubs, such as woods and irons, contain a series of parallel grooves in the ball striking face for imparting spin to the golf ball. For example, backspin is used to cause the ball to stop abruptly once it hits the ground by counteracting the forward motion of the ball. Accomplished players can also impart spin to the ball to selectively cause the ball to fade to the right or draw to the left (for a right-handed player) to avoid certain hazzards or take advantage of the terrain of the golf course. FIG. 4 shows a golf club head insert 36 comprising a lower layer 40 and an upper layer 44 having a series parallel grooves 48 therein. Diamond and PCBN are such hard materials that it is difficult and expensive to form such grooves in the diamond or PCBN materials themselves. Therefore, FIG. 5 shows an insert 52 comprising a lower layer 56 and an upper layer 60, wherein the upper layer 60 comprises a series of alternating parallel strips of diamond or PCBN material 64 and grooving material 68. The grooving material need only be wide enough in which to form the grooves, according to the design of club face grooves as is well known in the art. The grooving material is substantially softer than the diamond or PCBN material such that grooves can be formed in the ball striking face without excessive difficulty or expense. Suitable grooving materials include stainless steel, carbon, graphite, ceramics, plastics, metals, and nonmetals, with preferred grooving materials including tungsten, cobalt, iron, nickel, vanadium, chromium, titanium, zirconium, tantalum, molybdenum, $Si_3N_4$, SiC, $Al_2O_3$, boron, and copper.

Figure 6:
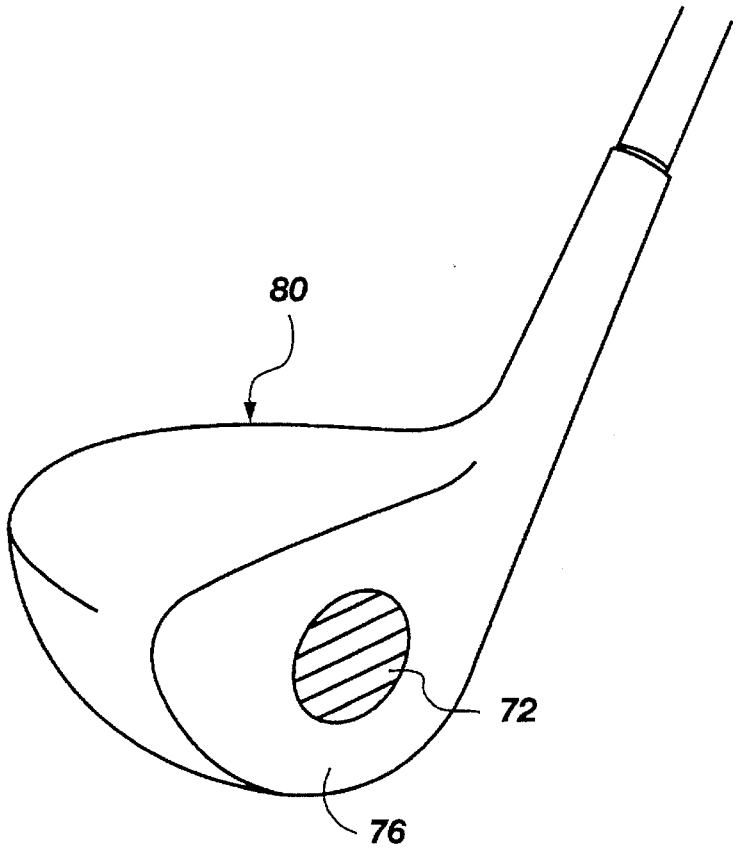
FIG. 6 shows a perspective view of a golf club head comprising a golf club head insert in the ball striking face according to the present invention.

The golf club head insert of the present invention can have any selected shape, such as circular, rectangular, octagonal, triangular, trapezoidal, hexagonal, and the like. The golf club head insert is attached to a conventional golf club face by soldering, brazing, or by mechanical and/or thermal attachment methods that are well known in the art. FIG. 6 shows a golf club head insert 72 attached to a golf club face 76 such that the surfaces of the insert and the face form a continuous, smooth ball striking face, i.e. the surfaces of the insert and of the face are coplanar. That is, the exposed surface of the insert neither forms a protrusion nor a depression in the ball striking face of the club head 80.

In the case of a putter, an ungrooved insert having a microflat surface provides a consistent surface for striking the ball. The insert provides a sound and feel that seem more solid and stronger, yet with a light feeling of impact. These characteristics allow for confidence in delivering power and accuracy from each shot.

The present invention is particularly advantageous, however, for use in irons and woods because of the improvements in distance and accuracy that can be obtained therewith. A grooved insert is used in such irons and woods such that spin can be imparted to the ball as described above. The diameter of the insert should ordinarily be greater in such irons and woods than in a putter because of the wider arc of the swinging motion and the greater variation in where the ball contacts the ball striking face of the club. The diameter of the insert can be as large or as small as desired within the limits of functionality. It should be recognized that more accomplished players can benefit from a smaller diameter insert, while less accomplished players would likely need a larger diameter insert. The only disadvantage to a larger diameter insert is cost. In all cases, the insert is positioned in the club face in the so-called "sweet spot" to provide optimum energy transfer to the ball. The inelastic character of the insert results in more efficient transfer of kinetic energy from the club to the ball, thus increasing the length of the shot. The golf club head insert of the present invention is also particularly advantageous for a driver or other wood because the size of the club head can be made smaller than the oversized heads that are currently popular. Smaller heads can possibly decrease air resistance, which can positively affect both distance and accuracy.

EXAMPLE 1

In this example, a PCD insert was prepared by the method of U.S. Pat. No. 3,745,623. The insert was cylindrical with a diameter of 19 mm and a height of 3.2 mm. The upper layer consisted of about 96% by volume of diamond and about 4% by volume of metal sintering aid materials, i.e. cobalt, tungsten, and tungsten carbide. The diamond layer was about 0.5 mm thick, and the support layer was about 2.7 mm thick. This ungrooved insert was placed in a commercially available ("PING") putter by the conventional thermal/mechanical press-fitting method.

EXAMPLE 2

The putter of Example 1 was tested by a ball drop test. The club head of the putter was placed horizontally on the ground, and then golf balls were dropped from 1–2 feet above the club head. Some balls were dropped on the PCD insert portion of the club face, while other balls were dropped on the non-PCD portion of the club face. Balls dropped on the PCD insert rebounded to a height 15–20% higher than balls dropped on the non-PCD portion of the club face.

EXAMPLE 3

A golf club head insert is prepared according to the method of Example 1 except that thermally stable PCD, prepared by the method of U.S. Pat. No. 4,224,380, is substituted for PCD.

EXAMPLE 4

A golf club head insert is prepared according to the method of Example 3 except that the thermally stable PCD is reinfiltrated with a metal or silicon according to methods well known in the art.

EXAMPLE 5

In this example, a tungsten carbide support layer 34 mm in diameter and 2.7 mm in thickness is coated with a diamond coating by the CVD process resulting in a golf club head insert according to the present invention.

EXAMPLE 6

In this example, a layer of PCBN 34 mm in diameter and 0.5 mm in thickness is prepared according to the method of U.S. Pat. No. 3,233,988. This PCBN layer is bonded to a support layer 34 mm in diameter and 2.7 mm in thickness of tungsten carbide by the HPHT method.

EXAMPLE 7

In this example, a cemented diamond compact is fabricated from 50% by volume diamond and 50% by volume of titanium binder according to the HPHT method. The cemented diamond compact is made in the form of a layer 34 mm in diameter and 0.5 mm in thickness. The cemented diamond compact layer is then bonded to a support layer of tungsten carbide 34 mm in diameter and 2.7 mm in thickness to result in a golf club head insert.

EXAMPLE 8

In this example, a single crystal diamond purchased from Sumitomo or DeBeers is shaped into a layer 19 mm in diameter and 0.5 mm in thickness. This diamond layer is then bonded to a support layer of titanium to result in a golf club head insert.

EXAMPLE 9

In this example, a PCD insert 34 mm in diameter and 0.5 mm in thickness is prepared by the HPHT method. This free-standing PCD insert is bonded to a receiving cavity formed in the face of a "titanium wood" head by the conventional thermal/mechanical press-fitting method.

EXAMPLE 10

In this example, a grooved insert 34 mm in diameter and 3.2 mm in thickness is prepared. The support layer is 2.7 mm thick tungsten carbide. The surface layer comprises alternating parallel strips of PCD and tungsten grooving material in 0.5 mm thickness. This surface layer is bonded to the support layer. Grooves are formed in the tungsten grooving material to result in an insert with parallel grooves according to FIG. 4.

We claim:

1. A golf club head comprising:

a ball striking face having a receiving cavity formed therein for receiving a golf club head insert; and a golf club head insert comprising (a) a surface layer of a compact material comprising a member selected from the group consisting of diamond and CBN crystals wherein said crystals are bonded together by diamond-diamond or CBN-CBN bonds between adjacent crystals, and (b) a support layer of a hard, rigid material to which said surface layer is bonded, wherein said golf club head insert is disposed in said receiving cavity such that the surface layer is coplanar with the ball striking face wherein said surface layer of said insert increases the amount of energy transferred to a struck golf ball.

2. The golf club head of claim 1 wherein said compact material is a member selected from the group consisting of PCD, thermally stable PCD, reinfiltrated PCD, and CVD diamond film.

3. The golf club head of claim 2 wherein said compact material is PCD and said PCD comprises about 50–99% by volume of diamond and about 1–50% by volume of a sintering aid material.

4. The golf club head of claim 3 wherein said sintering aid material is a member selected from the group consisting of iron, cobalt, nickel, ruthenium, rhodium, palladium, osmium, iridium, platinum, titanium, chromium, manganese, and tantalum.

5. The golf club head of claim 2 wherein said surface layer has a thickness of about 0.1 to about 20 mm.

6. The golf club head of claim 5 wherein said hard, rigid material of the support layer is a member selected from the group consisting of steels, metals, carbides, ceramics, and cermets.

7. The golf club head of claim 6 wherein said hard, rigid material of the support layer is a member selected from the group consisting of tungsten carbide, copper, tin, brass, nickel, aluminum, silicon, molybdenum, tungsten, cobalt, titanium, zirconium, $Al_2O_3$, SiC, and $Si_3N_4$.

8. The golf club head of claim 7 wherein said face is dimensioned for use in a putter-type club head.

9. The golf club head of claim 7 wherein said face is dimensioned for use in a wood-type or iron-type club head.

10. The golf club head of claim 9 wherein said surface layer comprises a series of alternating parallel strips of compact material and a grooving material, wherein a groove is formed in said grooving material to form a series of parallel grooves in said surface layer.

11. The golf club head of claim 10 wherein said grooving material is a member selected from the group consisting of stainless steel, carbon, graphite, ceramics, plastics, metals, and nonmetals, including tungsten, cobalt, iron, nickel, vanadium, chromium, titanium, zirconium, tantalum, molybdenum, $Si_3N_4$, SiC, $Al_2O_3$, boron, and copper.

12. The golf club head of claim 1 wherein said support layer has a periphery with a lip extending upwardly therefrom for defining a receiving cup for receiving and circumscribing the surface layer.

13. A golf club head comprising:

a ball striking face having a receiving cavity formed therein for receiving a golf club head insert; and a golf club head insert comprising a surface layer of a compact material comprising a member selected from the group consisting of diamond and CBN crystals wherein said crystals are bonded together by diamond-diamond or CBN-CBN bonds between adjacent crystals, wherein said golf club head insert is disposed in said receiving cavity such that the surface layer is coplanar with the ball striking face wherein said surface layer of said insert increases the amount of energy transferred to a struck golf ball.

14. The golf club head of claim 13 wherein said compact material is a member selected from the group consisting of PCD, thermally stable PCD, reinfiltrated PCD, CVD diamond film, and cemented compact.

15. The golf club head of claim 14 wherein said compact material is PCD and said PCD comprises about 50–99% by volume of diamond and about 1–50% by volume of a sintering aid material.

16. The golf club head of claim 15 wherein said sintering aid material is a member selected from the group consisting of iron, cobalt, nickel, ruthenium, rhodium, palladium, osmium, iridium, platinum, titanium, chromium, manganese, and tantalum.

17. The golf club head of claim 14 wherein said surface layer has a thickness of about 0.1 to about 20 mm.

18. The golf club head of claim 17 wherein said face is dimensioned for use in a putter.

19. The golf club head of claim 17 wherein said face is dimensioned for use in a wood-type or iron-type club head.

20. The golf club head of claim 19 wherein said surface layer comprises a series of alternating parallel strips of compact material and a grooving material, wherein a groove is formed in said grooving material to form a series of parallel grooves in said surface layer.

21. The golf club head of claim 20 wherein said grooving material is a member selected from the group consisting of stainless steel, carbon, graphite, ceramics, plastics, metals, and nonmetals, including tungsten, cobalt, iron, nickel, vanadium, chromium, titanium, zirconium, tantalum, molybdenum, $Si_3N_4$, SiC, $Al_2O_3$, boron, and copper.

22. A golf club head comprising:

a ball striking face having a receiving cavity formed therein for receiving a golf club head insert; and a golf club head insert comprising (a) a surface layer of a material comprising a member selected from the group consisting of a cemented compact and a single crystal diamond, and (b) a support layer of a hard, rigid material to which said surface layer is bonded, wherein said golf club head insert is disposed in said receiving cavity such that the surface layer is coplanar with the ball striking face wherein said surface layer of said insert increases the amount of energy transferred to a struck golf ball.

23. The golf club head of claim 22 wherein said surface layer comprises a cemented compact.

24. The golf club head of claim 23 wherein said cemented compact comprises about 5–93% by volume of diamond or CBN and about 7–95% by volume of a binder material.

25. The golf club head of claim 24 wherein said cemented compact comprises about 50–92% by volume of diamond or CBN and about 8–50% by volume of a binder material.

26. The golf club head of claim 25 wherein said binder material is a member selected from the group consisting of iron, cobalt, nickel, ruthenium, rhodium, palladium, osmium, iridium, platinum, titanium, chromium, manganese, and tantalum.

27. The golf club head of claim 22 wherein said surface layer has a thickness of about 0.1 to about 20 mm.

28. The golf club head of claim 27 wherein said hard, rigid material of the support layer is a member selected from the group consisting of steels, metals, carbides, ceramics, and cermets.

29. The golf club head of claim 28 wherein said hard, rigid material of the support layer is a member selected from the group consisting of tungsten carbide, copper, tin, brass, nickel, aluminum, silicon, molybdenum, tungsten, cobalt, titanium, zirconium, $Al_2O_3$, SiC, and $Si_3N_4$.

30. The golf club head of claim 29 wherein said face is dimensioned for use in a putter-type club head.

31. The golf club head of claim 29 wherein said face is dimensioned for use in a wood-type or iron-type club head.

32. The golf club head of claim 31 wherein said surface layer comprises a series of alternating parallel strips of cemented compact or single crystal diamond material and a grooving material, wherein a groove is formed in said grooving material to form a series of parallel grooves in said surface layer.

33. The golf club head of claim 32 wherein said grooving material is a member selected from the group consisting of stainless steel, carbon, graphite, ceramics, plastics, metals, and nonmetals, including tungsten, cobalt, iron, nickel, vanadium, chromium, titanium, zirconium, tantalum, molybdenum, $Si_3N_4$, SiC, $Al_2O_3$, boron, and copper.

34. The golf club head of claim 22 wherein said support layer has a periphery with a lip extending upwardly therefrom for defining a receiving cup for receiving and circumscribing the surface layer.

* * * * *